US008550734B2

(12) United States Patent
Nakayama

(10) Patent No.: US 8,550,734 B2
(45) Date of Patent: Oct. 8, 2013

(54) TRANSPORTATION GUIDE MECHANISM AND RECORDING DEVICE HAVING THE SAME

(75) Inventor: Ichiro Nakayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 887 days.

(21) Appl. No.: 12/550,308

(22) Filed: Aug. 28, 2009

(65) Prior Publication Data

US 2010/0051665 A1 Mar. 4, 2010

(30) Foreign Application Priority Data

Aug. 29, 2008 (JP) ..... 2008-220998
Aug. 6, 2009 (JP) ..... 2009-183138

(51) Int. Cl.
*B41J 13/00* (2006.01)

(52) U.S. Cl.
USPC ..... 400/642; 271/278; 399/405

(58) Field of Classification Search
USPC ..... 271/278; 400/642; 399/19, 397, 405
See application file for complete search history.

(56) References Cited

U.S. PATENT DOCUMENTS

| | | | | |
|---|---|---|---|---|
| 5,902,059 | A * | 5/1999 | Asai et al. | 400/605 |
| 6,276,848 | B1 * | 8/2001 | Takizawa et al. | 400/120.01 |
| 6,447,187 | B1 * | 9/2002 | Robinson | 400/621 |
| 6,749,352 | B2 | 6/2004 | Yamada et al. | |
| 7,241,063 | B2 * | 7/2007 | Sago et al. | 400/621 |
| 7,350,993 | B2 * | 4/2008 | Hirabayashi | 400/642 |
| 7,540,678 | B2 * | 6/2009 | Hirabayashi | 400/642 |
| 7,559,712 | B2 * | 7/2009 | Lee | 400/642 |
| 7,822,379 | B2 * | 10/2010 | Nakamura et al. | 399/405 |
| 2005/0281606 | A1 * | 12/2005 | Koyama et al. | 400/621 |
| 2007/0053735 | A1 * | 3/2007 | Lee | 400/642 |
| 2008/0213025 | A1 * | 9/2008 | Nakatani | 400/642 |
| 2009/0174139 | A1 * | 7/2009 | Chen | 271/278 |
| 2009/0174140 | A1 * | 7/2009 | Chen | 271/278 |
| 2010/0221058 | A1 * | 9/2010 | Inoue | 400/642 |
| 2010/0329761 | A1 * | 12/2010 | Ichiki et al. | 399/397 |
| 2011/0182647 | A1 * | 7/2011 | Kawaguchi | 400/642 |

FOREIGN PATENT DOCUMENTS

| | | | |
|---|---|---|---|
| JP | 07-290780 | A | 11/1995 |
| JP | 08-104463 | A | 4/1996 |
| JP | 2000-167799 | A | 6/2000 |
| JP | 2002-087638 | A | 3/2002 |
| JP | 2004-106500 | A | 4/2004 |

* cited by examiner

*Primary Examiner* — Kaitlin Joerger
(74) *Attorney, Agent, or Firm* — Kilpatrick Townsend & Stockton LLP

(57) ABSTRACT

A transportation guide mechanism and a recording device having the transportation guide mechanism can smoothly and stably discharge sheet media without impairing the ease of maintenance. The transportation guide mechanism 61 is disposed between the paper exit 4 of a paper feed mechanism 3 that can open and close to the printing unit 2 and a ticket transportation path 12 through which recording paper P discharged from the paper feed mechanism 3 passes, and guides the recording paper P discharged from the paper exit 4 to the ticket transportation path 12. The transportation guide mechanism 61 has a bottom guide panel 63 that renders the guide path 64 through which the recording paper P can pass. The bottom guide panel 63 is supported so that it is pushed by the paper feed mechanism 3 opening and closing to the printing unit 2 and can be displaced to a position outside the path of paper feed mechanism 3 movement.

5 Claims, 6 Drawing Sheets

TRANSPORTATION GUIDE MECHANISM AND RECORDING DEVICE HAVING THE SAME

This application claims priority to Japanese Patent Application No. 2008-220998, filed Aug. 29, 2008 and Japanese Patent Application No. 2009-183138, filed Aug. 6, 2009. The entireties of both of the aforementioned applications are incorporated by reference herein.

BACKGROUND

1. Technical Field

The present invention relates to a transportation guide mechanism for guiding a conveyed medium, and to a recording device having the transportation guide mechanism.

2. Related Art

Printers such as those used in electronic cash registers in POS (point of sale) systems are generally used to issue receipts by printing to rolled recording paper using a thermosensitive print head, for example. See, for example, Japanese Unexamined Patent Appl. Pub. JP-A-2000-167799.

Because printers of this type are built into a cash register or other ticket-issuing device, the recording paper that is printed and discharged from these printers is guided to a ticket exit rendered in the housing of the ticket-issuing device and discharged from the ticket exit.

In order to remove paper jams in the paper feed mechanism that conveys the recording paper and for cleaning and maintenance, it must be possible to open and close the paper feed mechanism by, for example, swinging the paper feed mechanism open and closed to the printing unit.

However, while a space must be provided between the ticket exit of the ticket-issuing device and the paper exit of the printer in order to provide the space required to open and close the paper feed mechanism so that the paper feed mechanism can be opened and closed, the recording paper discharged from the paper feed mechanism can leave the transportation path at this gap, resulting in the paper not being guided to the ticket exit rendered in the housing of the ticket-issuing device.

SUMMARY

A transportation guide mechanism and a recording device having the transportation guide mechanism according to the present invention enable smoothly and stably conveying sheet media without impairing the ease of maintenance.

A first aspect of the invention is a transportation guide mechanism that is disposed between an exit opening of a transportation mechanism that can open and close to a device body and a transportation path through which a sheet medium conveyed from the transportation mechanism is passed, and guides the medium conveyed from the exit opening to the transportation path, the transportation guide mechanism including a guide member rendering a guide path through which the medium can pass, the guide member being supported displaceably to a position removed from the path of transportation mechanism movement when pushed by the transportation mechanism opening and closing relative to the device body.

By passing the media discharged from the exit opening of the transportation mechanism through a guide path, the transportation guide mechanism according to this aspect of the invention can smoothly and consistently feed the medium through the gap between the exit opening of the transportation mechanism and the transportation path.

Furthermore, because the guide member is supported so that it is pushed by the transportation mechanism opening and closing to the device body and can be displaced to a position outside the path of transportation mechanism movement, the transportation mechanism can be opened to the device body for easily removing paper jams, cleaning, and maintenance.

Preferably, the guide member is pushed and moved to the transportation path side by the transportation mechanism opening relative to the device body.

Because the guide member is pushed and moved by the transportation mechanism opening relative to the device body, the guide member does not interfere when the transportation mechanism is opened, and the maintainability of the transportation mechanism can be improved. Furthermore, because the guide member is moved toward the transportation path side, problems caused by the position of the guide member separating from the transportation path as a result of the guide member moving are eliminated and the guide member can be moved.

Further preferably, the guide member is pushed and caused to move rotationally on a support point on the transportation path side by the transportation mechanism closing relative to the device body.

Because the guide member is pushed and caused to pivot by the transportation mechanism closing to the device body, the guide member does not interfere when the transportation mechanism is closed, and the maintainability of the transportation mechanism can be improved. Furthermore, because the guide member moves rotationally around a support point on the transportation path side, problems caused by the position of the guide member separating from the transportation path as a result of the guide member pivoting are eliminated and the guide member can be moved.

Yet further preferably, the guide member of the invention is supported pivotably to the device body, thus enabling a simple configuration.

Yet further preferably, the guide member is urged to a specific position by an urging member because the position is thus stable.

Another aspect of the invention is a recording device having the transportation guide mechanism described herein and a printing process unit that applies a printing process to the medium.

A recording device according to this aspect of the invention can smoothly and stably discharge sheet media by means of the transportation guide mechanism after printing on the sheet medium, and the transportation mechanism can be easily maintained.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of a transportation guide mechanism and a recording device having the transportation guide mechanism according to the present invention are described below with reference to the accompanying figures.

Figure 1:
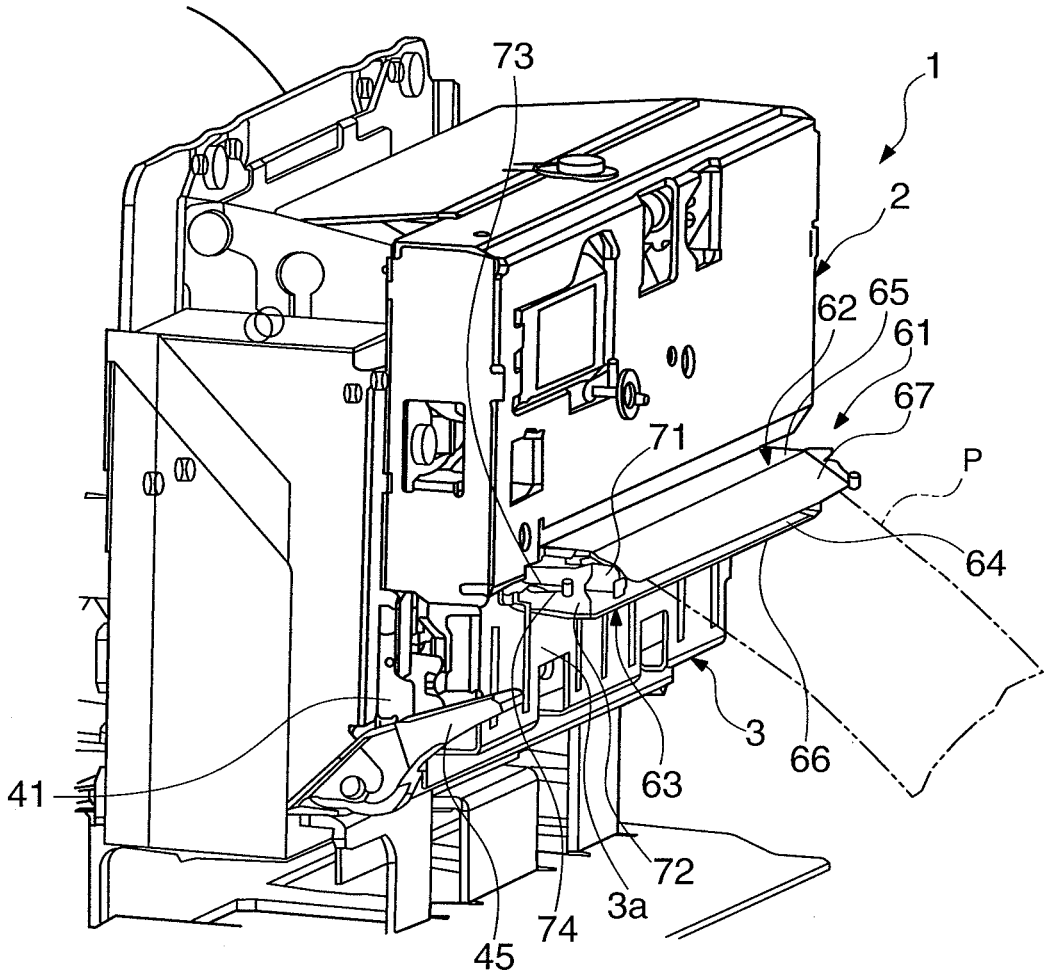
FIG. 1 is an oblique view of a recording device according to a preferred embodiment of the invention.
Figure 2:
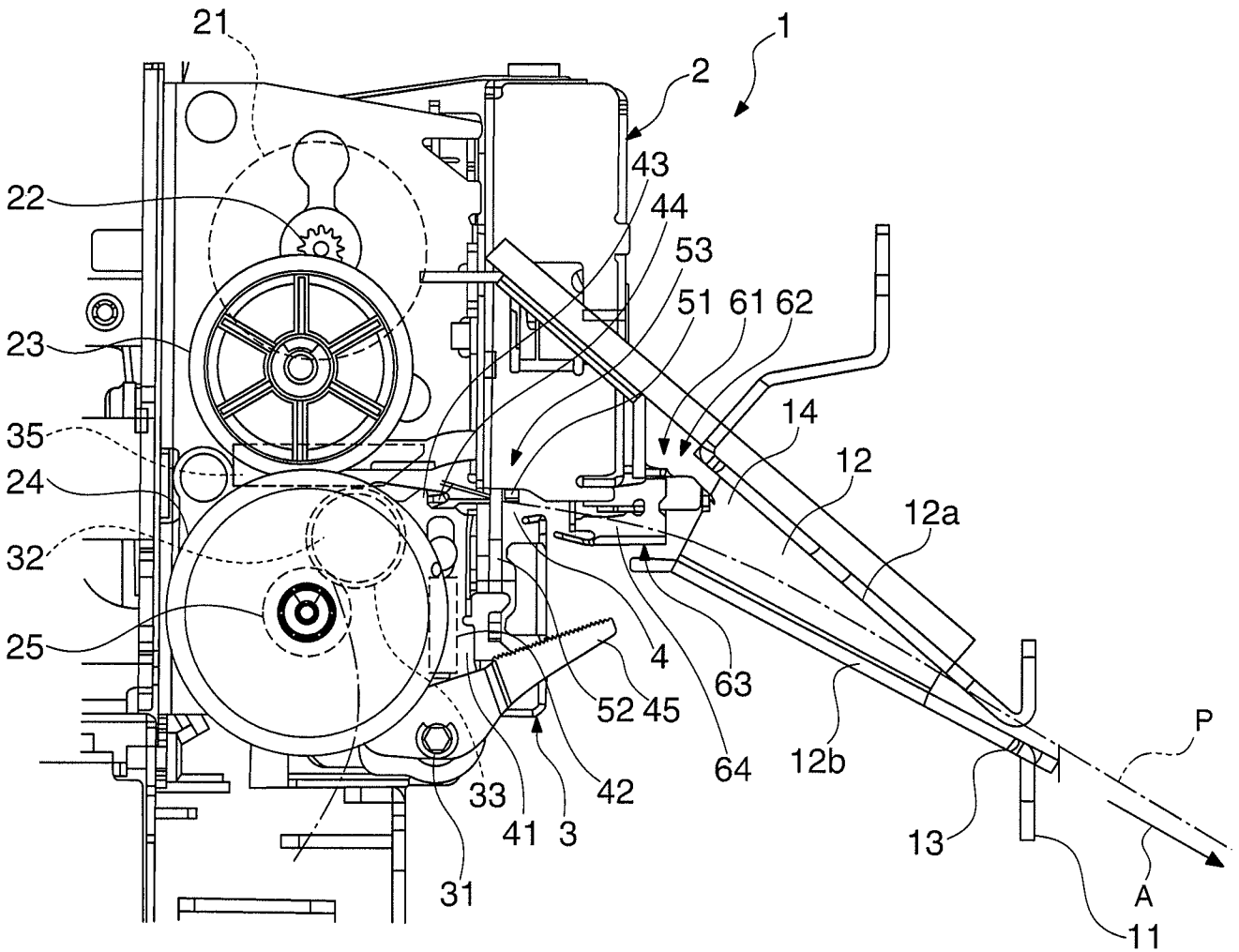
FIG. 2 is a section view of the recording device showing the configuration of the transportation guide mechanism.
Figure 3:
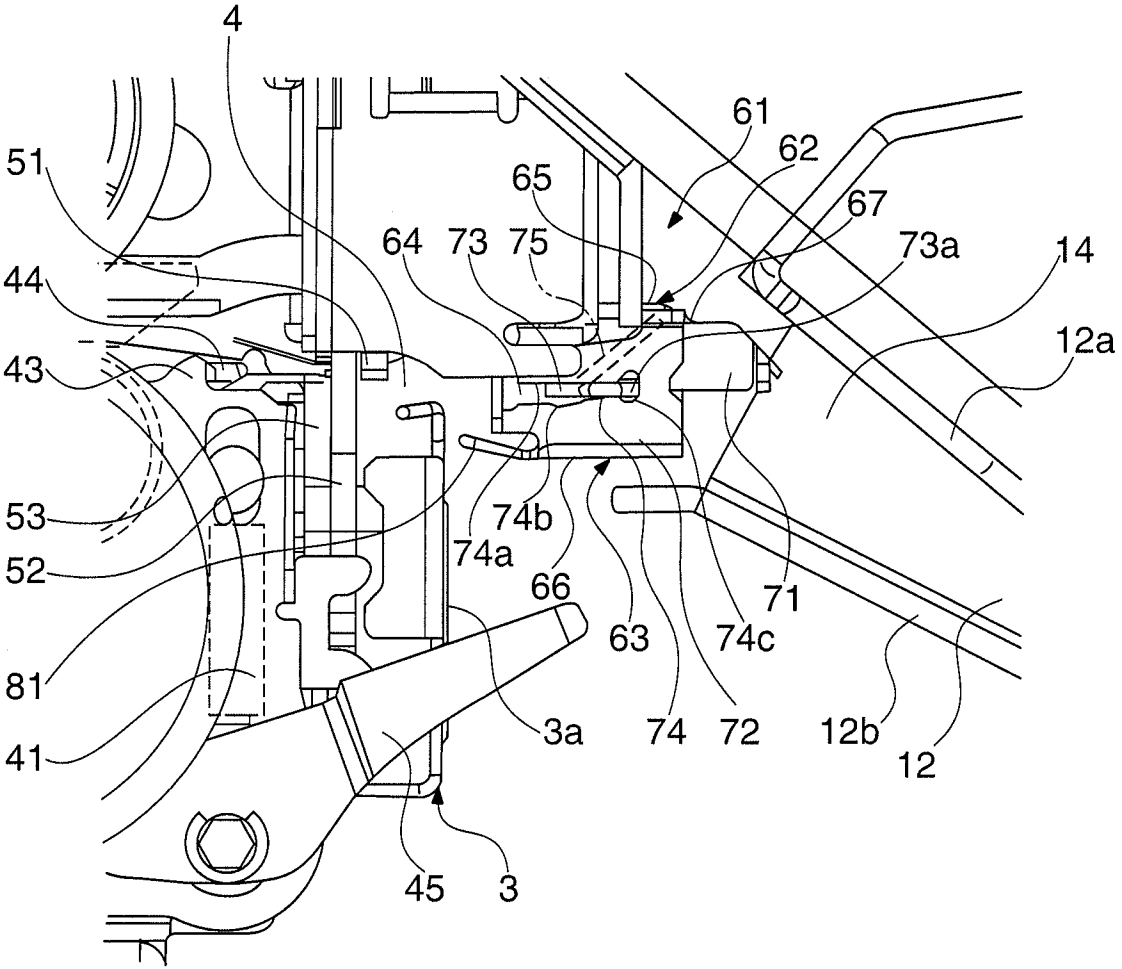
FIG. 3 is an enlarged section view of the transportation guide mechanism.
Figure 4:
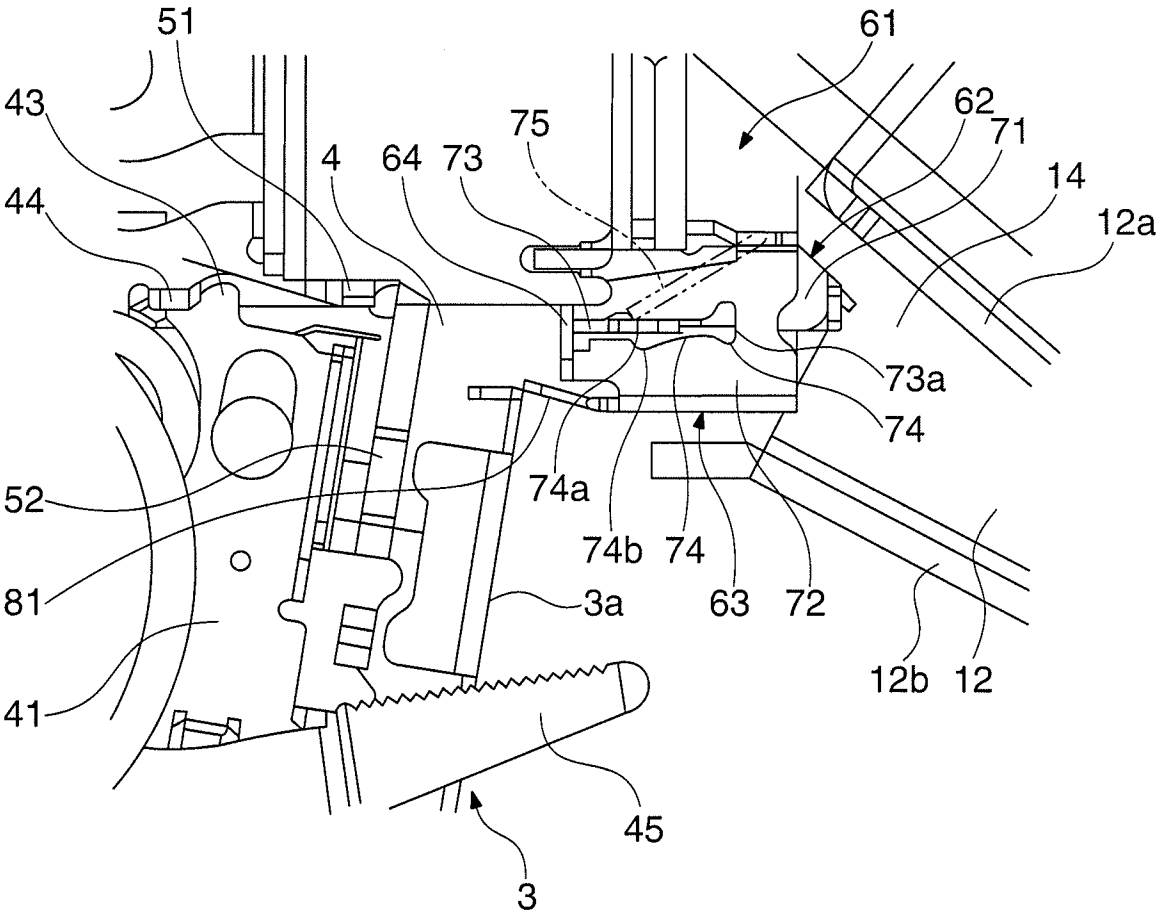
FIG. 4 is an enlarged section view describing the operation of the transportation guide mechanism.
Figure 5:
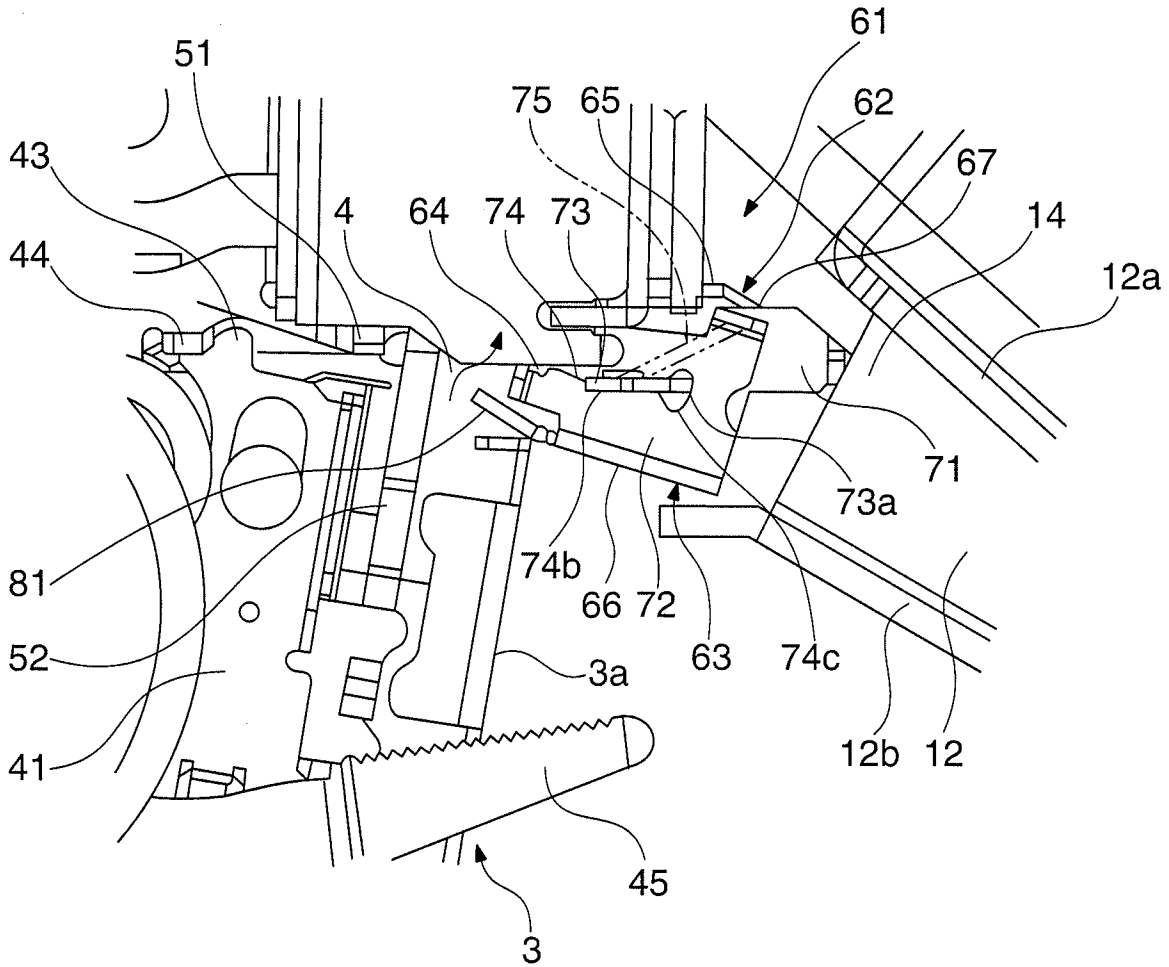
FIG. 5 is an enlarged section view describing the operation of the transportation guide mechanism.

FIG. 1 is an oblique view of a recording device according to a preferred embodiment of the invention, FIG. 2 is a section view of the recording device showing the configuration of the transportation guide mechanism, FIG. 3 is an enlarged section view of the transportation guide mechanism, and FIG. 4 and FIG. 5 are enlarged section views describing the operation of the transportation guide mechanism.

As shown in FIG. 1 and FIG. 2, the printer 1 described by way of example as a recording device according to this embodiment of the invention has a printing unit 2 (device unit) and a paper feed mechanism 3 (feed mechanism) disposed at the front bottom part of this printing unit 2.

The printer 1 is built into a ticket-issuing device that issues receipts, for example, and the printed recording paper (medium) P is conveyed from the paper exit 4 of the paper feed mechanism 3 to the ticket transportation path 12 (transportation path) rendered in the case 11 of the ticket-issuing device and discharged from the ticket exit 13 at one end of the ticket transportation path 12.

The ticket transportation path 12 has a top plate 12*a* and a bottom plate 12*b*, and the top plate 12*a* and bottom plate 12*b* are disposed sloping down in the discharge direction A of the recording paper P with the gap therebetween gradually narrowing. The printer 1 end of the ticket transportation path 12 is the ticket inlet 14, and the recording paper P discharged from the paper exit 4 of the paper feed mechanism 3 is fed into the ticket transportation path 12 from the ticket inlet 14.

The printing unit 2 has a stepping motor 21. The stepping motor 21 rotationally drives a motor gear 22, and a transfer gear 23 is engaged with the motor gear 22. An external gear 24 engages the transfer gear 23, and torque from the motor gear 22 is transferred through the transfer gear 23 to the external gear 24. An internal gear 25 is disposed to the same shaft as the external gear 24, and the internal gear 25 rotates in unison with the external gear 24 when the external gear 24 turns.

The paper feed mechanism 3 is attached to the printing unit 2 so that the paper feed mechanism 3 can pivot on a pivot pin 31 at the bottom end thereof forward from the printer 1. A platen gear 32 that engages the internal gear 25 on the printing unit 2 side is disposed to the paper feed mechanism 3. A platen roller 33 is disposed on the same rotational shaft as the platen gear 32, and the platen roller 33 rotates in conjunction with the platen gear 32 when the platen gear 32 turns.

A thermal head 35 (printing process unit) for recording on the recording paper P is disposed above the platen roller 33 of the paper feed mechanism 3, and is pushed to the platen roller 33 by a spring not shown.

The recording paper P delivered from the roll paper disposed in the bottom of the printer 1 winds from below the paper feed mechanism 3 around the platen roller 33, is printed on by the thermal head 35 while passing between the platen roller 33 and the thermal head 35, and is discharged from the paper exit 4 by the paper feed mechanism 3.

A cutter mechanism 53 having cutting knives 51 and 52 disposed on the printing unit 2 side and the paper feed mechanism 3 side is disposed to the printer 1, and at a specific timing this cutter mechanism 53 cuts the recording paper P being conveyed forward.

The paper feed mechanism 3 has an engaging plate 41 that is supported vertically movable and is urged upward by a tension spring 42. An engaging claw 43 is formed to the engaging plate 41. When the engaging plate 41 is urged up by the tension spring 42, the engaging claw 43 engages an engaged part 44 formed on the printing unit 2 side, and limits rotation of the paper feed mechanism 3. A release lever 45 is also disposed to the paper feed mechanism 3. When the release lever 45 is depressed, the engaging plate 41 is lowered in resistance to the urging force of the tension spring 42, and engagement of the engaged part 44 by the engaging claw 43 is released. As a result, the paper feed mechanism 3 can rotate to the front of the printer 1 pivoting on the pivot pin 31.

When the paper feed mechanism 3 pivots to the front, the space between the platen roller 33 and the thermal head 35 opens, enabling removing paper jams, cleaning, and maintenance.

A transportation guide mechanism 61 is disposed to the printer 1 projecting to the ticket transportation path 12 side from the printing unit 2 between the paper exit 4 of the paper feed mechanism 3 and the ticket transportation path 12. As shown in FIG. 3, the transportation guide mechanism 61 has a top guide panel 62 and a bottom guide panel 63 (guide member), and the space between the top guide panel 62 and bottom guide panel 63 is the guide path 64 through which the recording paper P is guided and passed. The distal end of the guide path 64 is inserted to the ticket inlet 14 to the ticket transportation path 12.

Mutually parallel plate units 65 and 66 are disposed to the top guide panel 62 and bottom guide panel 63, and an inclined plate unit 67 that projects from the plate unit 65 to the ticket transportation path 12 side and slopes along the ticket transportation path 12 extends from the top guide panel 62.

A support panel 71 that is curved toward the bottom guide panel 63 side is formed to both side parts of the top guide panel 62, and a connecting plate 72 that is curved toward the top guide panel 62 side is formed to both side parts of the bottom guide panel 63 along the outside surface of the support panel 71.

A guide plate 73 that protrudes to the side is disposed to the support panel 71 of the top guide panel 62, and a guide channel 74 in which the guide plate 73 is inserted is formed to the connecting plate 72 of the bottom guide panel 63.

The top side of the guide channel 74 functions as a guide wall 74*a* extending in the front-back direction of the printer 1. A recess 74*b* is formed on the bottom side of the guide channel 74.

A tension spring 75 is connected between the guide plate 73 and the top of the connecting plate 72 on the ticket transportation path 12 side, and the bottom guide panel 63 is urged diagonally downward to the printer 1 side by this tension spring 75. As a result, the edge part 73*a* of the guide plate 73 on the ticket transportation path 12 side contacts the edge part 74*c* of the guide channel 74 on the ticket transportation path 12 side, and the guide plate 73 contacts the guide wall 74*a* of the guide channel 74.

A contact plate 81 is formed on the printer 1 side of the bottom guide panel 63. This contact plate 81 is positioned on the pivot path (path of movement) traversed by the frame (an opening and closing member) 3*a* of the paper feed mechanism 3 when the paper feed mechanism 3 pivots on the pivot pin 31.

In a printer 1 equipped with the foregoing transportation guide mechanism 61, the recording paper P is fed to the front of the printer 1 from the paper exit 4 after printing by the thermal head 35 and passes between the paper exit 4 and the ticket transportation path 12 through the guide path 64 of the transportation guide mechanism 61, which protrudes from the printing unit 2 to the ticket transportation path 12 side and is inserted to the ticket inlet 14 to the ticket transportation path 12. As a result, the recording paper P will be fed into the ticket transportation path 12 and discharged from the ticket exit 13 without leaving the transportation path between the paper exit 4 and the ticket transportation path 12.

What happens in a printer 1 having the transportation guide mechanism 61 described above when the paper feed mechanism 3 is opened and closed to remove a paper jam or for cleaning or maintenance is described next.

Opening the Paper Feed Mechanism

When the paper feed mechanism 3 is pivoted on the pivot pin 31 to the front of the printer 1 in order to open the paper feed mechanism 3, the frame 3*a* of the paper feed mechanism 3 contacts the edge part of the contact plate 81 of the bottom guide panel 63 of the transportation guide mechanism 61.

When the paper feed mechanism 3 pivots further from this point, the bottom guide panel 63 is pushed toward the ticket transportation path 12 side in resistance to the urging force of the tension spring 75 by the frame 3*a* of the paper feed mechanism 3 as shown in FIG. 4.

When the frame 3*a* of the paper feed mechanism 3 moves forward in the direction of rotational movement from the position in contact with the contact plate 81 of the bottom guide panel 63, contact of the frame 3*a* with the contact plate 81 is released.

As a result, the bottom guide panel 63 is pulled to the printer 1 side by the urging force of the tension spring 75, the edge part 73*a* of the guide plate 73 on the ticket transportation path 12 side contacts the edge part 74*c* of the guide channel 74 on the ticket transportation path 12 side, and the guide plate 73 is set to a stable position in contact with the guide wall 74*a*.

Closing the Paper Feed Mechanism

When the paper feed mechanism 3 is pivoted on the pivot pin 31 to the back of the printer 1 in order to close the paper feed mechanism 3, the frame 3*a* of the paper feed mechanism 3 contacts the bottom of the contact plate 81 of the bottom guide panel 63 of the transportation guide mechanism 61.

When the paper feed mechanism 3 pivots further from this point, the bottom guide panel 63 is caused to pivot on the ticket transportation path 12 side by the frame 3*a* of the paper feed mechanism 3 as shown in FIG. 5, and the guide plate 73 enters the recess 74*b*.

When the frame 3*a* of the paper feed mechanism 3 moves forward in the direction of rotational movement from the position in contact with the contact plate 81 of the bottom guide panel 63, contact of the frame 3*a* with the contact plate 81 is released.

As a result, the bottom guide panel 63 is caused to move rotationally in the opposite direction by the urging force of the tension spring 75, the edge part 73*a* of the guide plate 73 on the ticket transportation path 12 side contacts the edge part 74*c* of the guide channel 74 on the ticket transportation path 12 side, and the guide plate 73 is set to a stable position in contact with the guide wall 74*a*.

As described above, the transportation guide mechanism according to this embodiment of the invention can smoothly and stably convey the recording paper P through the gap between the paper exit 4 of the paper feed mechanism 3 and the ticket transportation path 12 as a result of the recording paper P discharged from the paper exit 4 of the paper feed mechanism 3 passing through the guide path 64.

Furthermore, because the bottom guide panel 63 of the transportation guide mechanism 61 is supported displaceably to a position removed from the path of paper feed mechanism 3 movement when pushed by the paper feed mechanism 3 opening and closing to the printing unit 2, the paper feed mechanism 3 can be opened from the printing unit 2 so that jammed recording paper P can be easily removed and cleaning and maintenance are simple.

More specifically, recording paper P that has been printed on by the thermal head 35 can be smoothly and stably discharged by the transportation guide mechanism 61, and maintenance of the paper feed mechanism 3 can be done easily.

More particularly, because the bottom guide panel 63 is pushed and moved to the ticket transportation path 12 side by the paper feed mechanism 3 being opened from the printing unit 2, and is pushed and caused to move rotationally on a pivot point on the ticket transportation path 12 side by the paper feed mechanism 3 closing to the printing unit 2, the bottom guide panel 63 does not interfere with the paper feed mechanism 3 opening and closing, and maintenance of the paper feed mechanism 3 is thus made easier.

Furthermore, because the bottom guide panel 63 is moved toward the ticket transportation path 12 side when the paper feed mechanism 3 opens and moves rotationally on a pivot point on the ticket transportation path 12 side when the paper feed mechanism 3 closes, problems caused by the position of the bottom guide panel 63 separating from the ticket transportation path 12 as a result of the bottom guide panel 63 moving and pivoting are prevented, and the bottom guide panel 63 can be caused to move and pivot.

Other Embodiments

It will be obvious to one with ordinary skill in the related art that the present invention is not limited to the foregoing embodiment and can be varied in many ways without departing from the scope of the accompanying claims.

Figure 6:
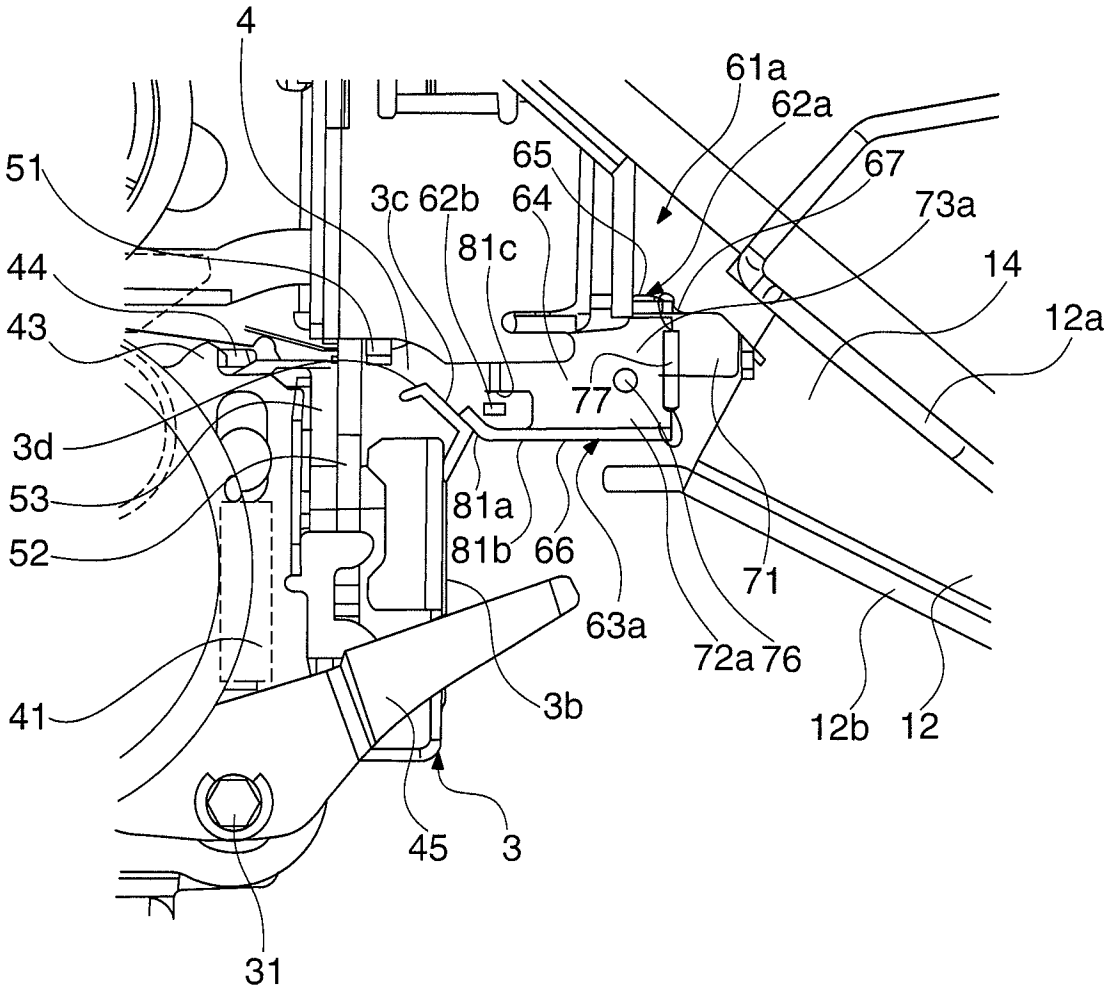
FIG. 6 is a lateral section view of the transportation guide mechanism in another embodiment of the invention.

FIG. 6 shows an example of such variations and is a lateral section view of the transportation guide mechanism portion of another embodiment of the invention. Note that in the figure and following description parts that are identical to or have the same function as a part in the first embodiment are identified by the same reference numerals, and further description thereof is omitted or simplified.

In the embodiment shown in FIG. 6 the transportation guide mechanism 61*a* protruding from the printing unit 2 to the ticket transportation path 12 side is supported so that the bottom guide panel 63*a* (guide member) can pivot to the top guide panel 62*a* on a support pin 76.

The bottom guide panel 63*a* is urged counterclockwise as seen in FIG. 6 by a tension spring 77 disposed between it and the top guide panel 62*a*, and the posture of the bottom guide panel 63*a* is controlled by an engaging part 81*c* disposed to the connecting plate 72*a* contacting a stop 62*b* disposed to the top guide panel 62*a*, or by the contact plate 81 a disposed to the bottom guide panel 63*a* contacting a contact surface 3*c* of the frame 3*b*.

Opening the frame 3*b* in this configuration and closing the opened frame 3*b* are described next.

Opening the Paper Feed Mechanism

When the frame 3*b* is pivoted on the pivot pin 31 to the front of the printer 1 in order to open the transportation path of the paper feed mechanism 3, the contact plate 81*a* of the bottom guide panel 63*a* is moved to the guide path 64 side by the contact surface 3*c* of the frame 3*b*, and the bottom guide panel 63*a* is moved rotationally clockwise in resistance to the urging force of the tension spring 77.

When the contact surface 3*c* of the frame 3*b* then rotates further in the direction of rotation from the position in contact with the contact plate 81*a* of the bottom guide panel 63*a*, contact of the frame 3*b* with the contact plate 81*a* is released.

As a result, the bottom guide panel 63*a* is moved rotationally counterclockwise by the urging force of the tension spring 77, and the engaging part 81*c* is set to a predetermined position in contact with the stop 62*b* disposed to the top guide panel 62*a* whereby the attitude of the engaging part 81*c* is regulated.

Closing the Paper Feed Mechanism

When the frame 3*b* is pivoted on the pivot pin 31 to the back of the printer 1 in order to close the open paper feed mechanism 3, the top end part 3*d* of the frame 3*b* contacts the bottom 81*b* of the bottom guide panel 63*b*.

When the frame 3*b* then rotates further, the bottom guide panel 63*a* moves rotationally clockwise on the support pin 76 in resistance to the urging force of the tension spring 77, and the bottom guide panel 63*a* rotates clockwise until the top end part 3*d* stops sliding along the bottom surface 81*b* and contact plate 81*a*. As the top end part 3*d* separates from the contact plate 81, the bottom guide panel 63*a* is rotated counterclockwise by the tension spring 77, and the contact plate 81 is set to a fixed position in contact with the stop 62*b*.

The configuration of this embodiment of the invention is simple and preferred because the bottom guide panel 63*a* simply pivots and its operation is stable.

Furthermore, while the foregoing embodiments are described using a thermal printer that prints by means of the thermal head 35 applying heat to the recording paper P, it will be obvious to one with ordinary skill in the related art that the invention may also be applied to inkjet printers that discharge ink to the recording paper P or other recording medium.

Furthermore, the bottom guide panel 63 used as the guide member in the foregoing embodiments is urged by a tension spring 75, but the urging member that urges the bottom guide panel 63 to a specific position is not limited to a tension spring, and a torsion spring, compression spring, or elastically deformable rubber member, for example, may be used instead.

Furthermore, while the guide path 64 through which the recording paper P is guided and passes is described as rendered by two parts, a top guide panel 62 and a bottom guide panel 63, it may be rendered by a single part, in which case the guide member rendering the guide path 64 is movably supported on the main unit.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A transportation guide mechanism that is disposed between an exit opening of a transportation mechanism that can open and close to a device body and a transportation path through which a sheet medium conveyed from the transportation mechanism is passed, and guides the medium conveyed from the exit opening to the transportation path, the transportation guide mechanism comprising:

a guide member rendering a guide path through which the medium can pass, the guide member being supported displaceably relative to the device body, the transportation mechanism moving through an opening movement path when the transportation mechanism is opened relative to the device body, the transportation mechanism contacting the guide member over a portion of the opening movement path and thereby displacing the guide member relative to the device body and the transportation mechanism to a position removed from the opening movement path, the transportation mechanism moving through a closing movement path when the transportation mechanism is closed relative to the device body, the transportation mechanism contacting the guide member over a portion of the closing movement path and thereby displacing the guide member relative to the device body and the transportation mechanism to a position removed from the closing movement path;

wherein the guide member is pushed and moved toward the transportation path by the transportation mechanism opening relative to the device body.

2. The transportation guide mechanism described in claim 1, wherein: the guide member is pushed and caused to move rotationally on a support point on a transportation path side by the transportation mechanism closing relative to the device body.

3. A recording device comprising:

the transportation guide mechanism described in claim 1; and a printing process unit that applies a printing process to the medium.

4. The transportation guide mechanism described in claim 1, wherein:

the guide member is pivotably coupled to the device body.

5. A transportation guide mechanism, comprising:

a transportation mechanism, defining an exit opening, and configured to open and close to a device body; and a guide member disposed between the exit opening and a transportation path through which a sheet medium conveyed from the transportation mechanism is passed, and defining a guide path configured to guide the medium conveyed from the exit opening to the transportation path, the guide member being supported displaceably relative to the device body;

wherein the transportation mechanism is configured to move through an opening movement path when the transportation mechanism is opened relative to the device body, the transportation mechanism being configured to contact the guide member over a portion of the opening movement path and thereby displace the guide member relative to the device body and the transportation mechanism to a position removed from the opening movement path;

wherein the transportation mechanism is further configured to move through a closing movement path when the transportation mechanism is closed relative to the device body, the transportation mechanism being configured to contact the guide member over a portion of the closing movement path and thereby displace the guide member relative to the device body and the transportation mechanism to a position removed from the closing movement path;

wherein the guide member is pushed and moved toward the transportation path by the transportation mechanism opening relative to the device body.

* * * * *